US010813413B1

(12) United States Patent
Stephenson et al.

(10) Patent No.: US 10,813,413 B1
(45) Date of Patent: Oct. 27, 2020

(54) BUCKLE CONFIGURED TO ACCEPT A SLOTLESS STRAP

(71) Applicant: 3M INNOVATIVE PROPERTIES COMPANY, St. Paul, MN (US)

(72) Inventors: Matthew S. Stephenson, Ames, IA (US); Judd J. Perner, Missouri City, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/757,979

(22) PCT Filed: Oct. 10, 2018

(86) PCT No.: PCT/IB2018/057858

§ 371 (c)(1),
(2) Date: Apr. 21, 2020

(87) PCT Pub. No.: WO2019/082011

PCT Pub. Date: May 2, 2019

Related U.S. Application Data

(60) Provisional application No. 62/575,811, filed on Oct. 23, 2017.

(51) Int. Cl.

| | |
|---|---|
| ***A41F 9/00*** | (2006.01) |
| ***A44B 11/24*** | (2006.01) |
| ***A44B 11/25*** | (2006.01) |

(52) U.S. Cl.
CPC ..... *A44B 11/24* (2013.01); *A44B 11/25* (2013.01)

(58) Field of Classification Search
CPC ..... A44B 11/24; A44B 11/25; A44B 11/2588; A44B 11/20; A44B 11/18; Y10T 24/4065; B65D 63/16; A41F 9/002
USPC ..... 2/231, 232
See application file for complete search history.

(56) References Cited

U.S. PATENT DOCUMENTS

| | | | | |
|---|---|---|---|---|
| 1,050,470 A | | 1/1913 | Kurtz | |
| 1,393,881 A | * | 10/1921 | Burg | A44B 11/18 24/193 |
| 2,807,852 A | | 10/1957 | Rave | |
| 3,121,270 A | * | 2/1964 | Van Den Broek | B65D 63/16 24/312 |
| 5,438,734 A | * | 8/1995 | Anderson | A44B 11/18 24/170 |
| 5,875,523 A | | 3/1999 | Chen | |

(Continued)

FOREIGN PATENT DOCUMENTS

| | | |
|---|---|---|
| CH | 245769 | 11/1946 |
| EP | 2716173 | 4/2014 |
| TW | 496647 | 3/2015 |

OTHER PUBLICATIONS

How to fasten a double D ring belt, Business Today, Nov. 24, 2013, [Retrieved from the internet on Jun. 18, 2020), URL <https://www.businesstoday.in/magazine/btmore/fashion/how-to-fasten-a-double-d-ring-belt/story/200184.html>, 1 page.

(Continued)

*Primary Examiner* — Jack W Lavinder
(74) *Attorney, Agent, or Firm* — Kenneth B. Wood

(57) ABSTRACT

A buckle that includes a frame with a first slot and a tongue assembly with a second slot. A terminal section of a strap can be passed through the first and second slots and turned back on itself to form a loop.

20 Claims, 5 Drawing Sheets

(56) References Cited

U.S. PATENT DOCUMENTS

| | | | | |
|---|---|---|---|---|
| 2005/0086772 | A1 | 4/2005 | Yoshiguchi | |
| 2010/0058562 | A1* | 3/2010 | Aveni | A44B 11/20 24/190 |
| 2013/0269155 | A1 | 10/2013 | Chang | |
| 2017/0150786 | A1* | 6/2017 | Ness | A44B 11/18 |

OTHER PUBLICATIONS

International Search Report for PCT International Application No. PCT/IB2018/057858, dated Jan. 23, 2019, 4 pages.

* cited by examiner

BUCKLE CONFIGURED TO ACCEPT A SLOTLESS STRAP

CROSS REFERENCE TO RELATED APPLICATIONS

This application is a national stage filing under 35 U.S.C. 371 of PCT/IB2018/057858, filed Oct. 10, 2018, which claims the benefit of provisional Application No. 62/575,811, filed Oct. 23, 2017, the disclosure of which is incorporated by reference in its/their entirety herein.

BACKGROUND

Buckles are widely used in the art for coupling two straps together, e.g. for use in safety harnesses and the like.

SUMMARY

In broad summary, herein is disclosed a buckle that includes a frame with a first slot and a tongue assembly with a second slot. A terminal section of a strap can be passed through the first and second slots and turned back on itself to form a loop. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Figure 1:
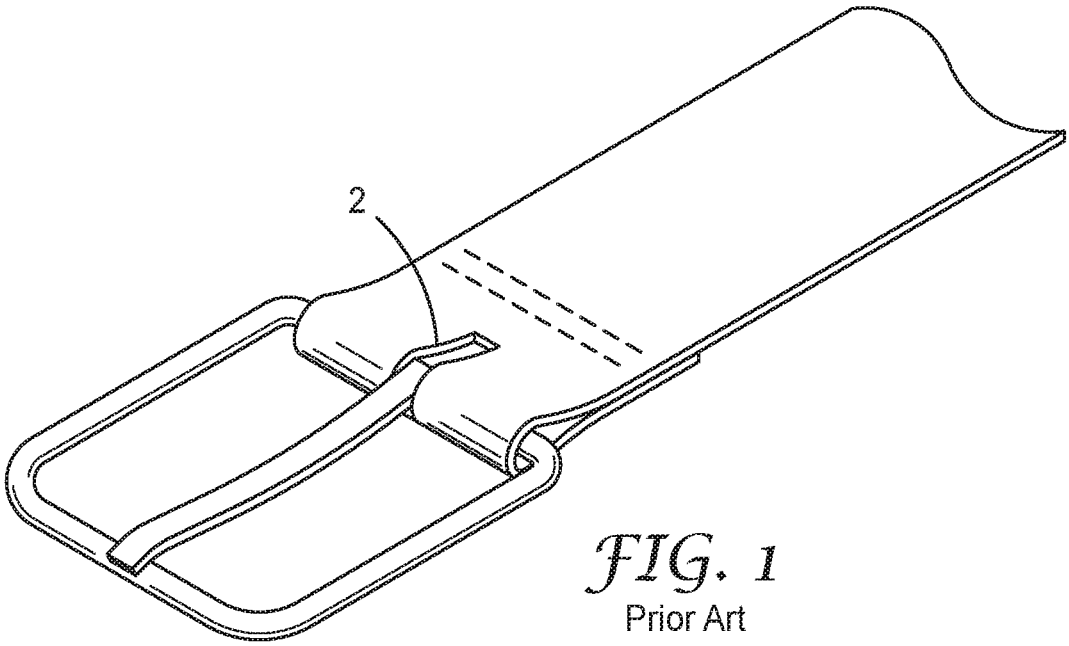
FIG. 1 Prior Art
FIG. 1 is a perspective view of an exemplary prior art buckle.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "first" and "second" may be used in this disclosure, it should be understood that those terms are used in their relative sense only unless otherwise noted.

As used herein in describing a buckle and components thereof, the term rearward and like terms refer to a direction generally toward an end of a strap to which the buckle is non-removably attached. The term forward and like terms refer to a direction generally opposite the rearward direction. (Forward and rearward directions are respectively leftward and rightward in the views of FIGS. 1-5 and 7). The term lateral refers to a direction that is generally perpendicular to the forward-rearward axis of the buckle, generally in a major plane of the buckle. Forward-rearward axes and lateral axes of various buckle components are denoted in various Figures. The term non-removably attached denotes items that are attached to each other so that they are not intended to be detached from each other in ordinary use of the buckle, and that cannot be detached from each other without unacceptably destroying or damaging at least one of the items.

The term "aligned" denotes that an axis of a specified item is at an angular orientation that is at least generally, substantially, or essentially parallel to a reference axis. In particular, "laterally-aligned" (and "laterally-oriented") refer to a component (e.g. a crossbar) that is at least generally aligned with a lateral axis of an item (e.g. a frame or a tongue assembly) that bears the component. The term aligned is specific to angular orientation and does not require that the axes of the two items must necessarily be e.g. superimposed. In other words, two items that are "aligned" with each other will exhibit axes that are at least generally parallel to each other, but the long axes may be rectilinearly spaced apart or offset from each other. A description that items are "proximate" to each other or in "proximity" to each other means that the items are within 10 mm of each other at their distance of closest approach. A description that items are in "close" proximity or "closely proximate" to each other means that the items are within 2 mm of each other at their distance of closest approach.

As used herein as a modifier to a property or attribute, the term "generally", unless otherwise specifically defined, means that the property or attribute would be readily recognizable by a person of ordinary skill but without requiring a high degree of approximation (e.g., within +/−20% for quantifiable properties). By generally aligned is meant within an angular orientation of clockwise or counterclockwise 30 degrees. The term "substantially", unless otherwise specifically defined, means to a high degree of approximation (e.g., within +/−10% for quantifiable properties). By substantially aligned is meant within an angular orientation of clockwise or counterclockwise 10 degrees. The term "essentially" means to a very high degree of approximation (e.g., within plus or minus 2% for quantifiable properties). By essentially aligned is meant within an angular orientation of clockwise or counterclockwise 5 degrees. It will be understood that for all items characterized as being at least generally aligned, this subsumes the specific cases in which the items are at least substantially aligned or at least essentially aligned. It will be understood that the phrase "at least essentially" subsumes the specific case of an "exact" match. However, even an "exact" match, or any other characterization using terms such as e.g. same, equal, identical, uniform, constant, and the like, will be understood to be within the usual tolerances or measuring error applicable to the particular circumstance rather than requiring absolute precision or a perfect match. The term "configured to" and like terms is at least as restrictive as the term "adapted to", and requires actual design intention to perform the specified function rather than mere physical capability of performing such a function.

DETAILED DESCRIPTION

Buckles have been used in the art for various purposes. Often, such a buckle will comprise a frame that is non-removably attached to an end of a strap (e.g. a belt, a webbing of a harness, and so on), and will comprise an elongate tongue whose rear end is pivotally mounted on (e.g., deformed around) a rear crossbar of the frame, as in the exemplary prior art design presented in FIG. 1. As shown in FIG. 1, such designs conventionally require a slot 2 (e.g. a rectangular slot with a long axis aligned with a long axis of the strap) to be provided in a terminal section of the strap, so that the terminal section of the strap can be passed around the rear crossbar and turned upon itself to form a loop to attach the frame to the strap, without the strap interfering with the ability to pivotally mount the tongue on the rear crossbar of the frame.

Disclosed herein is a buckle 1 that can function without necessarily requiring a slot to be provided in a terminal section of a strap to which the buckle is non-removably attached. As shown in exemplary embodiment in FIGS. 2-5, buckle 1 comprises a frame 10 and a tongue assembly 30. As most easily seen in the exploded view of FIG. 4, frame 10 comprises a rearward portion 26 that comprises a first laterally-extending slot 22. Tongue assembly 30 comprises a rearward portion 35 that comprises a second laterally-extending slot 41. Frame 10 and tongue assembly 30 are configured (e.g. first and second laterally-extending slots 22 and 41 are at least generally, substantially, or essentially superimposable with each other) so that a terminal section 52 of a strap 50 can be passed through slots 22 and 41 and turned back on itself to form a loop, as shown in exemplary embodiment in FIG. 2.

In some such embodiments, an elongate tongue 42 of the buckle may protrude forwardly from an intermediate crossbar 39 of tongue assembly 30 of the buckle (as evident from FIG. 4), rather than a rear end of the tongue being pivotally mounted directly on a rear crossbar 18 of the frame of the buckle. The presence of a terminal section 52 of strap 50 that is passed through slots 22 and 41 will not interfere with such an arrangement, nor will the presence of the terminal end of the strap interfere with the ability to rotate the tongue assembly as needed in ordinary operation of the buckle.

It will be appreciated that the above-described arrangements can eliminate the need to provide a slot (e.g., slot 2, shown in phantom lines in FIG. 2 to indicate where such as slot could be, but is not required to be) in the terminal section 52 of strap 50 to accommodate mounting an elongate tongue on a crossbar of a buckle frame. The arrangements presented herein can thus eliminate the need to remove material from the terminal section of the strap to provide such a slot. Such removal of material (e.g. by blade cutting, laser cutting, and so on) may be cumbersome or difficult particularly in the case of a strap that is comprised of high strength and/or high-temperature-resistant material, as is often the case for straps used for e.g. safety harnesses, belts and the like.

Figure 4:
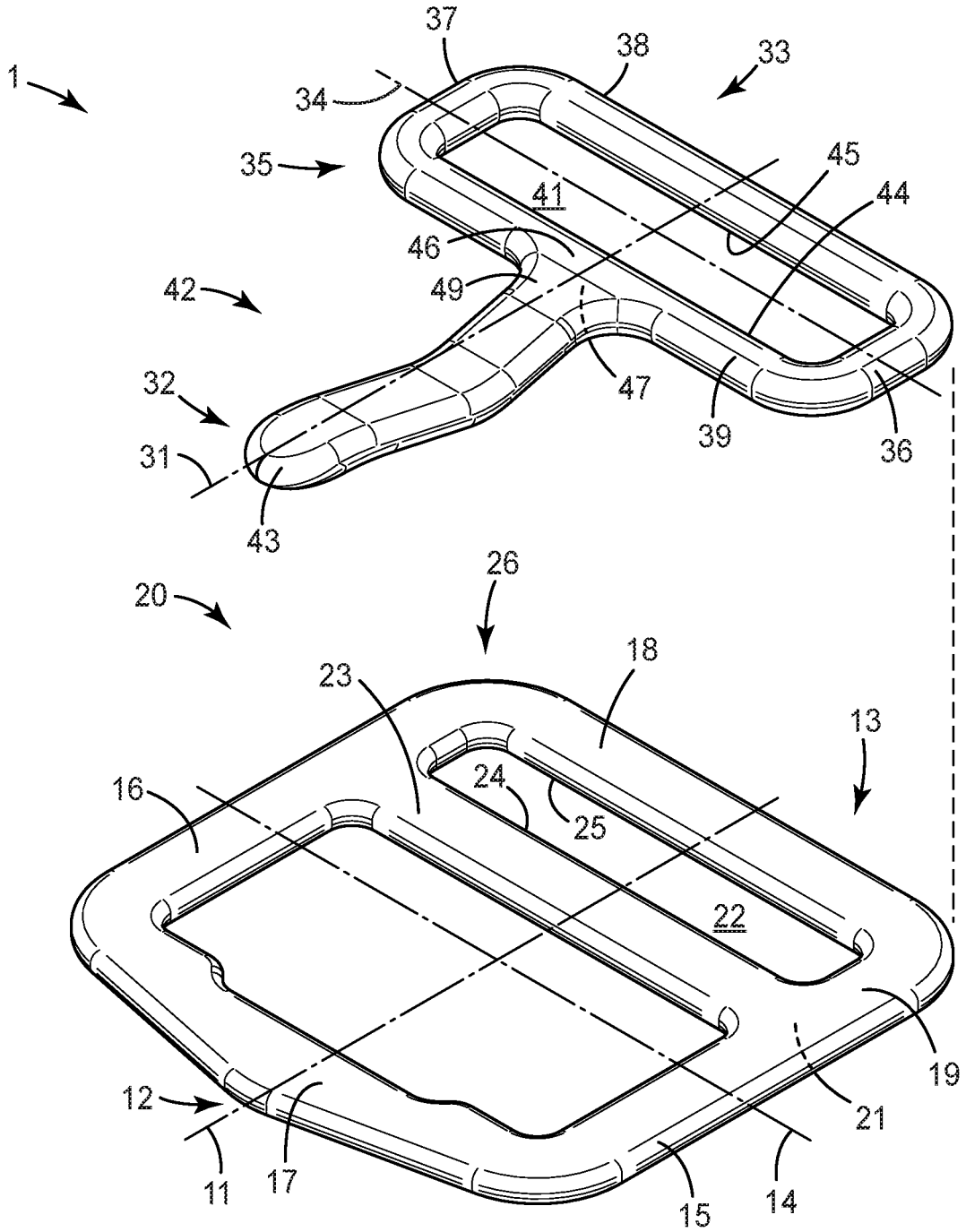
FIG. 4 is a perspective view of the buckle of FIG. 3, with the frame and the tongue assembly of the buckle exploded away from each other.

In further detail, frame 10 comprises a forward-rearward axis 11 (as indicated in FIG. 4), a forward end 12, and a rearward end 13. Frame 10 comprises first and second laterally-opposing siderails 15 and 16, which may be at least generally aligned with the forward-rearward axis of frame 10. Frame 10 comprises a strikebar 17 positioned at or near forward end 12 of frame 10, a rear crossbar 18 positioned at or near rearward end 13 of frame 10, and optionally an intermediate crossbar 23 positioned between forward strikebar 17 and rear crossbar 18. Any or all of these crossbars may extend at least generally across a lateral width of the frame (e.g. from siderail 15 to siderail 16), and may be oriented at least generally in alignment with a lateral axis 14 of frame 10. In some embodiments, forward strikebar 17, rear crossbar 18, and intermediate crossbar 23 if present, may extend continuously across the lateral width of frame 10 (e.g. from siderail 15 to siderail 16). In other embodiments, at least one such crossbar may comprise one or more gaps therein, as long as any such gap does not unacceptably lower the strength of frame 10.

Figure 2:
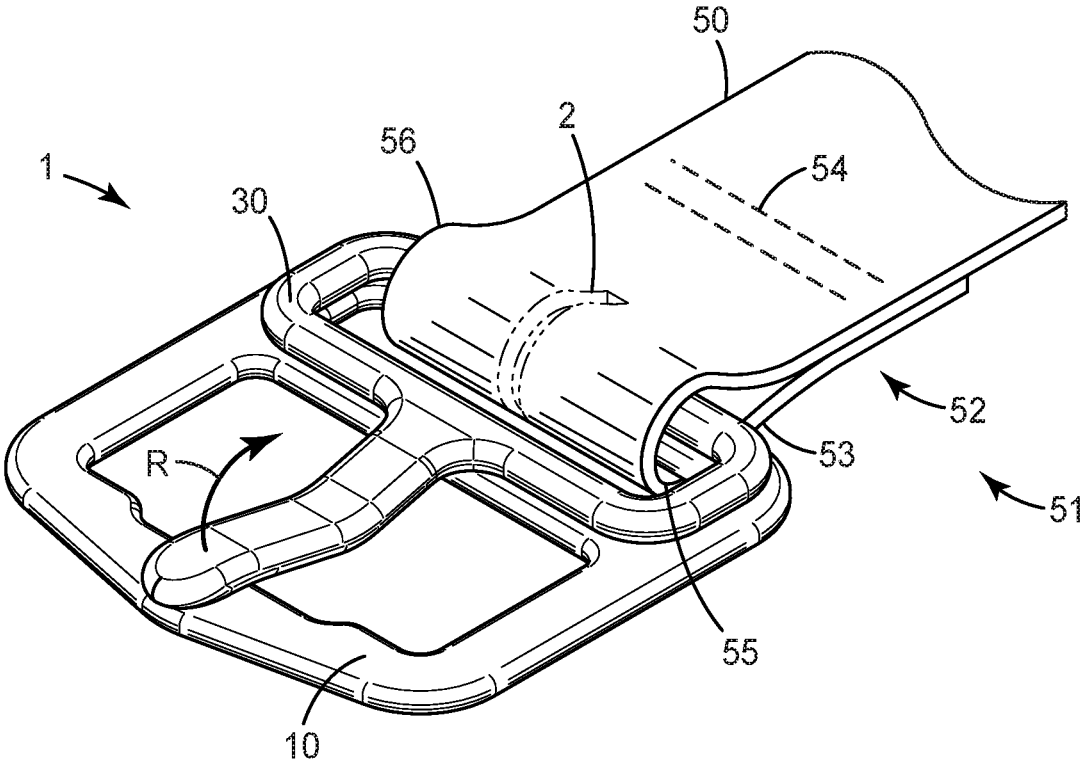
FIG. 2 is a perspective of an exemplary buckle as disclosed herein, along with a strap to which the buckle is non-removably attached.
Figure 3:
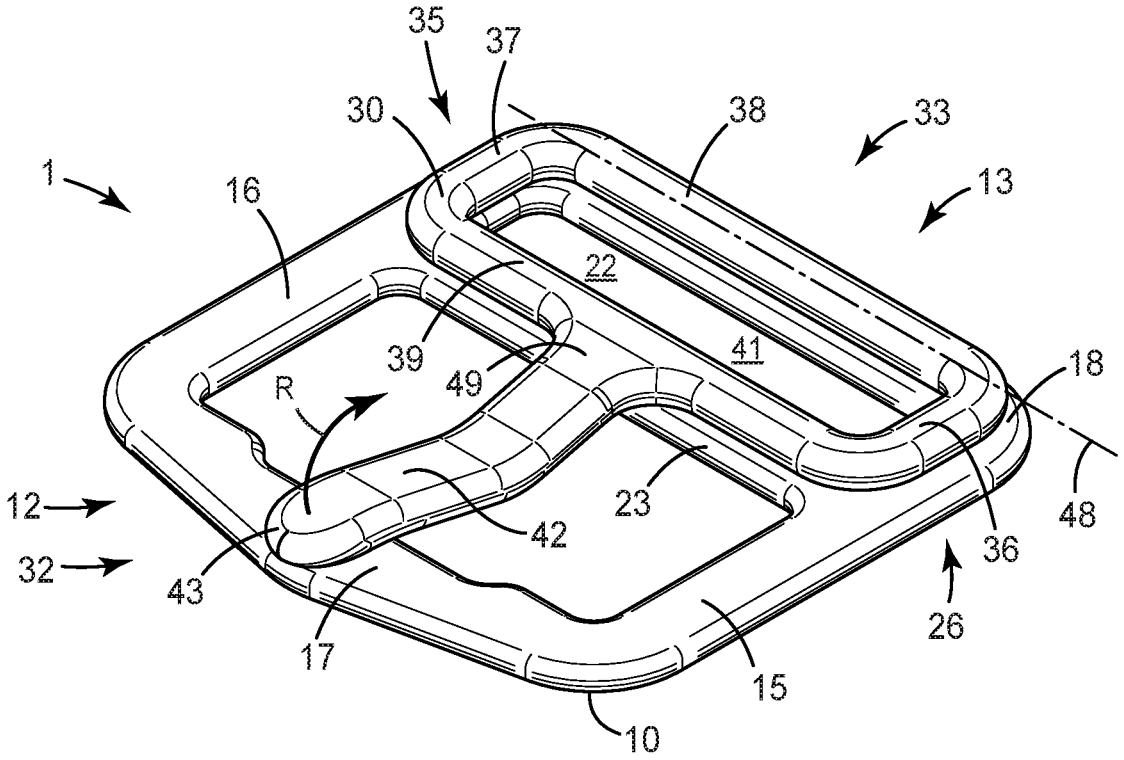
FIG. 3 is a perspective view of the buckle of FIG. 2 with the strap omitted.

As noted above, frame 10 comprises a rearward portion 26 that comprises a first laterally-extending slot 22. By a "slot" is meant an opening that extends completely through the shortest dimension (i.e. the "thickness") of frame 10, e.g. from "top" surface 19 to "bottom" surface 21 of frame 10. By laterally-extending is meant a slot that is at least generally aligned with lateral axis 14 of frame 10 and that exhibits a lateral extent of sufficient size (e.g. width) to allow a terminal section of a strap to be passed into and through the slot. In some embodiments (e.g. as in FIG. 4), such a slot may be longer in lateral dimension than in forward-rearward dimension, so as to exhibit an elongate appearance with a long axis that is oriented in at least general alignment with the lateral axis 14 of frame 10. It is emphasized that, intermediate crossbar 23 as shown in FIG. 3 being optional, in some embodiments no such intermediate crossbar may be present, e.g. as in the exemplary design of FIG. 7. In such embodiments, a rearward portion 26 of frame 10 will still be considered to comprise a laterally-extending slot 22; the slot will be a rearward region of the overall through-aperture bounded by forward strikebar 17, siderails 15 and 16, and rear crossbar 18. Slot 22 will allow a terminal section 52 of a strap 50 to be passed into and through slot 22 in order to non-removably attach tongue assembly 30 to terminal end 51 of strap 50 e.g. as shown in FIG. 2.

In further detail, in some embodiments rearward portion 26 of frame 10 may comprise items (e.g. crossbars and siderails) that collectively define all boundaries of first laterally-extending slot 22. For example, in some embodiments, a front edge 25 of rear crossbar 18 may define a rear boundary of slot 22; portions of siderails 15 and 16 may define lateral boundaries of slot 22. In embodiments in which frame 10 comprises an intermediate crossbar 23, a rear edge 24 of the intermediate crossbar may define a forward boundary of slot 22, as in the exemplary embodiment of FIG. 4. However, in some embodiments, not all boundaries of a slot 22 of a rearward portion 26 of a frame 26 may necessarily be explicitly provided by items of frame 10. For example, in embodiments in which an intermediate crossbar is not present, a forward boundary of slot 22 can be a "virtual" boundary that is denoted e.g. by a location within slot 22 that is aligned with rear edge 44 of intermediate crossbar 39 of tongue assembly 30 (which is described in detail later herein) when tongue assembly 30 is abutted atop frame 10 as in FIG. 7. It is emphasized that such arrangements are encompassed within the herein-disclosed concept of a rearward portion of a frame comprising a laterally-extending slot.

Frame 10 comprises a "top" surface 19 and an opposing, "bottom" surface 21. In some embodiments frame 10 may be relatively planar or flattened in appearance (e.g. as in FIG. 4) so as to exhibit a major plane. In some embodiments forward strikebar 17, rear crossbar 18, intermediate crossbar 23 if present, and siderails 15 and 16, may all be integral portions of a single, integral frame. In some convenient embodiments such an integral frame may be a single piece of stamped metal. In other embodiments the frame may be a single piece of forged metal. Regardless of the specific method of manufacture, in some embodiments frame 10 may be comprised of a rigid material, e.g. a metal such as steel, stainless steel, alloy steel, aluminum, or the like. (Here and elsewhere, by rigid is meant a material that exhibits a Young's modulus of at least 50 GPa.) Edges or corners of frame 10 may be rounded or smoothed as desired (as in the exemplary frame of FIG. 4), may be coated with any suitable material (e.g. zinc) as desired.

Buckle 1 further comprises a tongue assembly 30. Tongue assembly 30 comprises a forward-rearward axis 31 (as indicated in FIG. 4), a forward end 32, and a rearward end 33. Frame 10 comprises a rearward portion 35 that comprises first and second opposing siderails 36 and 37, which may be at least generally aligned with forward-rearward axis 31 of tongue assembly 30. Tongue assembly 30 comprises a rear crossbar 38 positioned at or near rearward end 33 of tongue assembly 30, and an intermediate crossbar 39 positioned forwardly of rear crossbar 38. Crossbars 38 and 39 may extend at least generally across a lateral width of rearward portion 35 of tongue assembly 30 (e.g. from siderail 36 to siderail 37), and may be at least generally aligned with a lateral axis 34 of tongue assembly 30. In some embodiments, rear crossbar 38 and intermediate crossbar 39 may extend continuously across the lateral width of rearward portion 35 of tongue assembly 30 (e.g. from siderail 36 to siderail 37). In other embodiments, at least one such crossbar may comprise one or more gaps or interruptions therein, as long as any such gap does not unacceptably lower the strength of tongue assembly 30.

As noted earlier herein, tongue assembly 30 comprises a rearward portion 35 that comprises items (e.g. crossbars 38 and 39 and siderails 36 and 37) that define a second laterally-extending slot 41. (The terms "slot" and "laterally-extending" are used in the same sense as described above for slot 22). In many embodiments (e.g. as in FIG. 4), slot 41 may be longer in lateral dimension than in forward-rearward dimension, so as to exhibit an elongate appearance with a long axis that is oriented in at least general alignment with the lateral axis 34 of tongue assembly 30. Slot 41 will allow terminal section 52 of a strap 50 (e.g. the same terminal section that is passed through slot 22) to be passed into and through slot 41 in order to non-removably attach tongue assembly 30 to terminal end 51 of strap 50 as shown in FIG. 2.

Thus in many embodiments, tongue assembly 30 and frame 10 are both non-removably attached to terminal end 51 of strap 50, but without tongue assembly 30 (or elongate tongue 42 thereof) being e.g. directly pivotally attached to frame 10. This may be contrasted to conventional arrangements such as shown in prior art FIG. 1, in which a rear end of an elongate tongue is directly pivotally attached to a buckle frame by way of the rear end of the elongate tongue being wrapped around a rear crossbar of the buckle frame.

In some embodiments, a front edge 45 of rear crossbar 38 of tongue assembly 30 may define a rear boundary of slot 41 of tongue assembly 30. Portions of siderails 36 and 37 may define lateral boundaries of slot 41. A rear edge 44 of intermediate crossbar 39 may define a forward boundary of slot 41, as in the exemplary embodiment of FIG. 4. Tongue assembly 30 further comprises at least one elongate tongue 42 that extends forwardly from rearward portion 35 of tongue assembly 30; in many convenient embodiments tongue 42 may extend forwardly from intermediate crossbar 39. In some embodiments tongue 42 may comprise a forward tip 43 and a rearward shank 49 by which tongue 42 is connected (e.g. is integrally attached to) intermediate crossbar 39. In many embodiments tongue 42 may comprise a long axis that is at least generally aligned with the forward-rearward axis 31 of tongue assembly 30, as in the exemplary embodiment of FIG. 4. While two or more tongues may be used if desired, in many embodiments a single tongue 42 may be used, e.g. at least substantially aligned with forward-rearward axis 31 of tongue assembly 30 and positioned in the lateral center of tongue assembly 30, again as shown in FIG. 4.

At least the rearward portion 35 of tongue assembly 30 comprises a "top" surface 46 and an opposing, "bottom" surface 47. During use of buckle 1, "bottom" surface 47 of tongue assembly 30 may often be positioned in close proximity to, e.g. in contact with, "top" surface 19 of frame 10, as is evident from inspection of FIG. 2. In some embodiments at least rearward portion 35 of tongue assembly 30 may be relatively planar or flattened in appearance (e.g. as in FIG. 4) so as to exhibit a major plane. In various embodiments tongue 42 may likewise lie at least generally in this major plane; however, in some embodiments tongue 42 may exhibit a slight dip, valley or bend (as evident in FIGS. 3 and 4).

In some embodiments rear crossbar 38, intermediate crossbar 39, siderails 36 and 37, and elongate tongue 42 may all be integral portions of a single, integral tongue assembly 30. In some convenient embodiments such an integral tongue assembly may be a single piece of stamped metal (with a subsequent deformation process being applied to tongue 42 if it is desired that tongue 42 exhibit a dip or bend). In other embodiments the tongue assembly may be a single piece of forged metal. Regardless of the specific method of manufacture, in some embodiments tongue assembly 30 may be comprised of a rigid material, e.g. a metal such as steel, stainless steel, alloy steel, aluminum or the like. Edges or corners of tongue assembly 30 may be rounded or smoothed as desired (as in the exemplary design of FIG. 4), may be coated with any suitable material (e.g. zinc) as desired.

In the production of buckle 1, frame 10 and tongue assembly 30 are arranged in juxtaposition with each other so that they collectively form a buckle 1; specifically, so that first slot 22 of frame 10, and second slot 41 of tongue assembly 30, are superimposed upon each other. By this is meant that slot 22 and slot 41 are placed into overlapping relation with each other e.g. as shown in FIG. 3, to a sufficient extent that a terminal section 52 of a strap 50 can be passed through the superimposed slots. This may be done e.g. by rotating tongue assembly 30 about its axis of rotation 48 into a position similar to that shown in FIG. 3. In some embodiments slot 22 and slot 41 may be "exactly" superimposed e.g. as shown in FIG. 3. However, in some embodiments the alignment of the slots may only be partial (and/or one slot may be shaped or sized somewhat differently from the other slot, rather than being substantially identical as in the exemplary design of FIG. 3), as long as the terminal section of the strap can be passed through the superimposed regions of the slots.

After being passed through the superimposed slots, terminal section 52 of strap 50 is turned back on itself to form a terminal loop 53 as shown in exemplary embodiment in FIG. 3. By turned back on itself is meant that an end region of terminal section 52 is brought at least into close proximity to (e.g. is brought into contact with) a penultimate region of terminal section 52 and the two regions are then non-separably attached to each other, e.g. to arrive at an arrangement of the general type indicated in exemplary embodiment in FIG. 2. In the exemplary embodiment of FIG. 2, this is done by stitching the two regions of terminal section 52 together with stitches 54; however, this may be done in any convenient manner, e.g. by the use of mechanical fasteners such as one or more rivets, studs, clasps, clamps, ferrules, or the like, and/or by the use of adhesive bonding, solvent bonding, melt-bonding, or the like. In cases in which strap 50 is comprised of filaments, strands, or the like, such attaching may include (either alone, or as an adjunct to any of the above-listed methods) interweaving or splicing strands of one region with strands from the adjacent region. In some embodiments, a layer of reinforcing material (e.g. a webbing, which may or may not be made of the same material as strap 50) may be attached to the major surface of terminal section 52 that will become the radially inward surface of the thus-formed loop 53. Such a layer (often referred to as a "wear pad") may provide enhanced abrasion resistance. In some embodiments, terminal section 52 of strap 52 may comprise a lateral extent (width) that occupies at least about 50, 60, 70, 80, or 90% of the lateral extent of slot 22 and/or of slot 41. Thus, in some embodiments lateral edges 55 and 56 of terminal section 52 of strap 50 may be closely proximate siderails 15 and 16 of frame 10, and/or siderails 36 and 37 of rearward portion 35 of tongue assembly 30.

The above-described arrangements will thus provide a terminal loop 53 that passes through the superimposed slots 22 and 41. In some embodiments (e.g. as in the exemplary design of FIG. 2) such a loop 53 may be the only means by which frame 10 and tongue assembly 30 are positioned so that tongue assembly 30 can rotate relative to frame 10 in order that these components can collectively function as a buckle. In such embodiments, loop 53 of strap 50 may co-encircle at least a portion of rear crossbar 18 of frame 10 along with at least a portion of rear crossbar 38 of tongue assembly 30. By co-encircle is meant that a portion of loop 53 at least generally circumferentially surrounds portions of both of the crossbars. First rear crossbar 18 of frame 10, and second rear crossbar 38 of tongue assembly 30, may thus be held in proximity to each other while allowing tongue assembly 30 to rotate relative to frame 10, about an axis of rotation 48 as shown in FIG. 3. In many embodiments such an axis of rotation will be proximate or closely proximate to rearward end 33 (and thus to rear crossbar 38) of tongue assembly 30 and may be at least generally aligned with lateral axis 34 of tongue assembly 30. In such embodiments this axis of rotation will also be proximate rearward end 13 of frame 10 and rear crossbar 18 of frame 10, and may be at least generally aligned with lateral axis 14 of frame 10.

The arrangements disclosed herein can provide that, at least in some embodiments, an axis of rotation 48 of tongue assembly 30 relative to frame 10 does not pass through any portion of frame 10 (as can be seen by inspection of FIG. 3). Rather, even though such an axis of rotation may be proximate rear crossbar 18 of frame 10, it may be rectilinearly offset from crossbar 18 (and from all portions of frame 10). Such arrangements can assist in achieving a configuration in which a tongue is rotatable with respect to a frame in order to facilitate functioning of a buckle, without necessitating a slot in the terminal end of a strap to which the frame is attached. It will be appreciated that embodiments in which an axis of rotation of a tongue assembly does not pass through any portion of a frame, will exclude arrangements in which a rear end of an elongate tongue is deformed about a crossbar of a frame (e.g., is bent to at least generally encircle the crossbar) so that the tongue comprises an axis of rotation that passes through the crossbar, as in the prior art design of FIG. 1

In some embodiments, a terminal loop of the strap may not be the only means by which frame 10 and tongue assembly 30 are held in position so that tongue assembly 30 can rotate relative to frame 10 in order that the components collectively function as a buckle. As shown in exemplary illustration in FIG. 5, in some embodiments one or more cinctures (e.g. collars) 70 can be provided that co-encircle at least a portion of first rear crossbar 18 of frame 10 and at least a portion of second rear crossbar 38 of tongue assembly 30. Any desired number of cinctures may be used, e.g. spaced along the lateral extent of rear crossbars 18 and 38. In some embodiments, a single cincture 70 may be used, e.g. in the form of an elongated annular sleeve as shown in the exemplary design of FIG. 5. Such a sleeve may be formed e.g. of a piece of sheet metal that is deformed e.g. into an at least generally circular (when viewed in cross-section) tube. Such an annular sleeve may thus comprise a small gap somewhere along its circumference; such a gap does not imply that the sleeve does not co-encircle rear crossbars 18 and 38. In some embodiments, such an annular sleeve may extend along at least about 20, 30, 40, 50, 60, 70, 80, or 90% of the elongate length of rear crossbars 18 and 38. Thus, in some embodiments lateral edges 71 and 72 of an annular sleeve 70 may be closely proximate siderails 15 and 16 of frame 10, and/or siderails 36 and 37 of rearward portion 35 of tongue assembly 30.

Any such cincture (e.g. annular sleeve) may be comprised of any suitable material (e.g. metal). If desired, a radially outer major surface 73 of such a cincture may be coated with a suitable material to minimize any wear on a strap that is wrapped around major surface 73 of the sleeve in being passed through slots 22 and 41 in order to form a loop as described above. Any such cincture should not interfere with the ability to rotate tongue assembly 30 about its axis of rotation; such a cincture may thus comprise a size (e.g. diameter, or equivalent diameter e.g. if the cincture is slightly oval in cross-sectional shape) that is chosen in view of the dimensions of rear crossbars 18 and 38.

Strap 50 may be made of any suitable material, depending e.g. on the purposes to which strap 50 is to be put. As noted, in many embodiments strap 50 may be a webbing, e.g. a filamentary (e.g. woven) fabric comprised of e.g. nylon, polypropylene, polyester, or the like. In particular embodiments such a webbing may include meta or para aramid materials (e.g. the products available from DuPont under the trade designations KEVLAR or NOMEX, or the product available from Teijin under the trade designation TECHNORA) or the like. Ordinary artisans will know that many such materials are mechanically tough and thus difficult to cut mechanically, and/or are high-temperature resistant and thus difficult to e.g. laser cut. It will thus be appreciated that the arrangements disclosed herein, which can eliminate any need to cut a slot into the terminal section of a strap, can offer considerable advantages.

It is emphasized that any requirement that the terminal end of a strap does not comprise a "slot", is "slotless", or like designations, is limited to the exclusion of a slot that is provided for the specific purpose of allowing a rearward shank of a buckle tongue to reside therein and to be rotatable about a rear crossbar of a frame without undue interference by the strap. Such a requirement does not mean that the strapping cannot have e.g. depressions, apertures, or the like, at other locations of the strap and/or for other purposes (whether e.g. decorative or functional).

Figure 6:
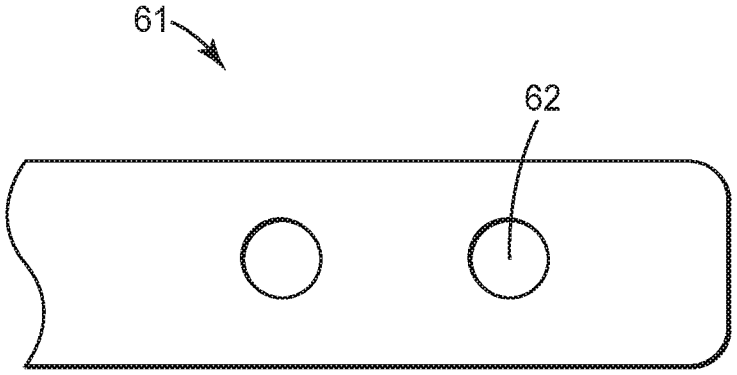
FIG. 6 is a plan view of terminal end of a strap that may be removably fastened to the buckle.
Figure 7:
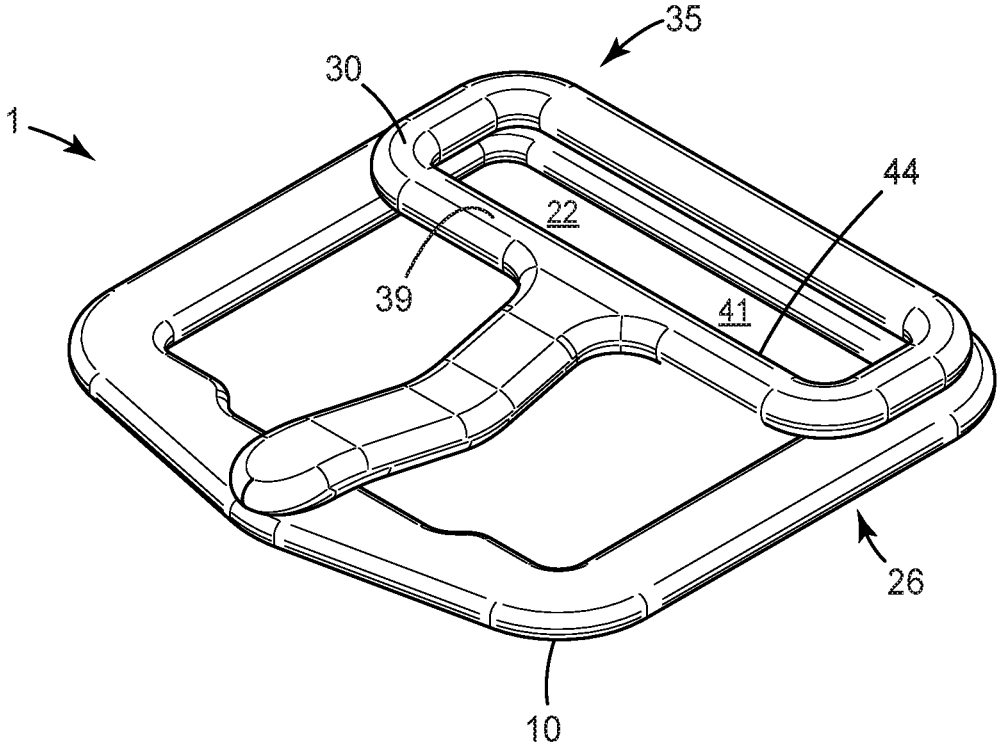
FIG. 7 is a perspective view of another exemplary buckle as disclosed herein.

In some embodiments, strap 50 may be elongate, e.g. with a relatively long length in comparison to a shorter lateral width and an even shorter thickness. However, in some embodiments a buckle may be mounted e.g. on a harness by a relatively short strap; thus a strap 50 may not necessarily be elongate. In many embodiments terminal section 52 of a strap 50 will be at a first, buckle end 51 of a strap 50. Such a strap may be elongate, with a second end 61 (as shown in FIG. 6) that is at an opposite end of strap 50 from buckle end 51. As shown in exemplary embodiment in FIG. 6, one or more apertures 62 may be provided at second end 61 of strap 50 to provide that buckle 1 can be used to fasten the second end 61 of a strap 50, to the first, buckle end 51 of the same strap 50. In other embodiments, an end 61 as pictured in FIG. 6 may be an end of a strap (e.g. an elongate strap) that is a separate strap from the strap 50 that comprises buckle 1. In such embodiments, buckle 1 is thus used to connect a first strap and a second strap together.

As will be well understood by artisans in the field, a buckle 1 that is non-removably attached to an end of a strap 50 as disclosed herein, may be used in similar manner as is customary for such buckles. That is, a strap 50 with a buckle 1 (e.g. of the general type shown in FIG. 2) non-removably attached thereto, will be provided to a user. The user can rotate tongue assembly 30 in the direction indicated by the curved block arrow of FIGS. 1 and 3 so that forward tip 43 of tongue 42 moves away from forward strikebar 17 of frame 10 to the extent necessary that an end section 61 of a strap may be passed through the opening defined by frame 10 (in a design such as in FIGS. 1-5, such an opening will be forward of the intermediate crossbar 23 of the frame). End section 61 can be passed through frame 10 sufficiently far that forward tip 43 of tongue 42 of tongue assembly 30 is brought into close proximity to an aperture 62 of end section 61 of the strap. Tongue 42 and/or end section 61 can then be manipulated to guide tongue 42 into aperture 62, after which end section 61 and tongue assembly 30, can be snugged down (tightened) to the extent desired. End section 61 of a strap can thus be detachably buckled (fastened) to buckle 1. The process can be reversed when it is desired to loosen or unbuckle end section 61 from buckle 1.

The discussions herein make it clear that in some embodiments a buckle may be supplied in the form of two pieces (e.g. a frame and a tongue assembly) that are independent, separately-made pieces that are not necessarily directly connected to each other in the manner of a conventional buckle with a tongue with a rear end that is deformed about a rear crossbar of the buckle frame so as to be directly pivotally attached to the frame. Rather, in some embodiments the two pieces are merely held in proximity to each other (e.g. by a terminal loop of a strap) so that they can collectively function as a buckle.

The discussions so far have mentioned exemplary configurations in which an axis of rotation of a tongue assembly does not pass through any portion of a frame with which the tongue assembly is used. However, it will be appreciated that in some embodiments such a condition may not be necessary. For example, a tongue assembly e.g. of the type shown in FIG. 4 might comprise one or more members that extend rearwardly and/or "downwardly" from rear crossbar 38 and that are deformed to wrap around or encircle portions of a rear crossbar 18 of frame 10. (Such members would of course be different from, and separate from, the tongue or tongues of the tongue assembly.) In embodiments of this type, an axis of rotation of tongue assembly 30 may pass through a portion of frame 10 (e.g. it may be coincident with rear crossbar 18 of frame 10), but it will nevertheless still be possible to superimpose the respective slots 22 and 41 of the frame and the tongue assembly, for the purposes disclosed herein.

Still further, in some embodiments a terminal section 52 of a strap 50 need not be turned back onto itself to form a terminal loop 53 in order to non-removably attach the frame and tongue assembly to the end of the strap. For example, in some embodiments a terminal section of a strap may be passed through the superimposed slots as described earlier herein, with the terminal section then being permanently formed (e.g. folded) into a structure that prevents the terminal section from being pulled back through the slots. Such a structure might be, for example, a T-structure, an accordionized or Z-folded structure, or the like. The various regions of the terminal section may be stitched or otherwise fastened together in any suitable manner to form such a structure; in some embodiments one or more reinforcing members (e.g. elongate metal bars or rods) may be incorporated into the thus-formed structure to provide additional rigidity.

Figure 5:
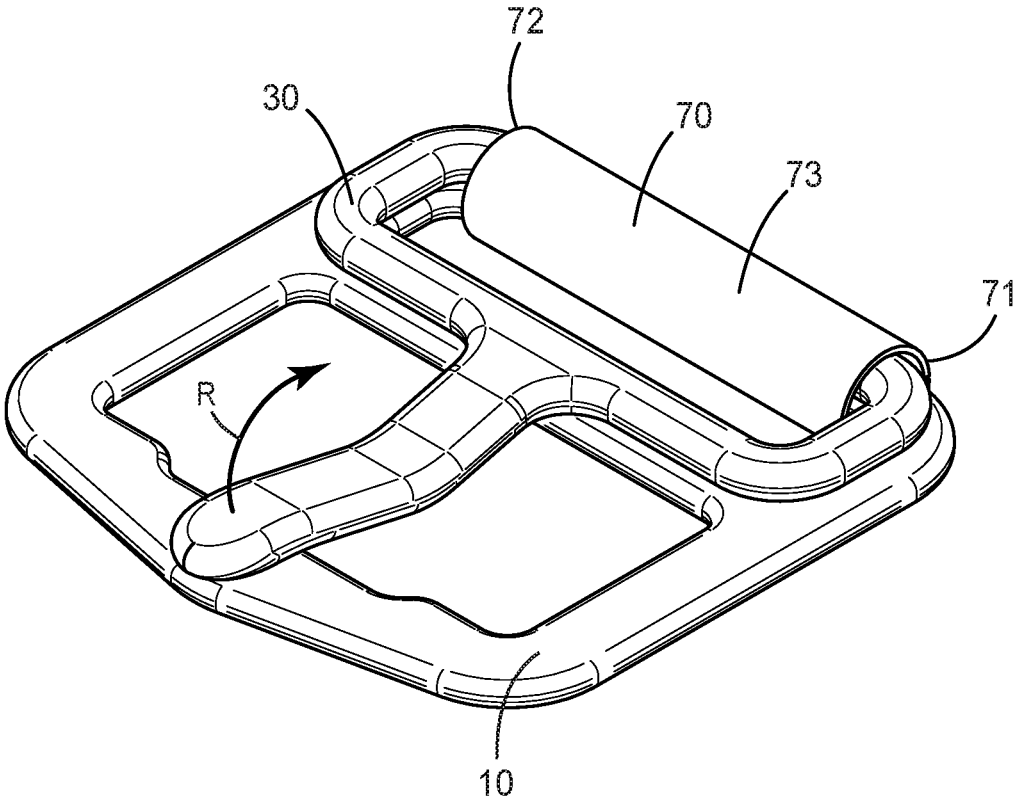
FIG. 5 is a perspective view of another exemplary buckle as disclosed herein.

Still further, a forward strikebar 17 need not be slightly tapered (e.g. V-shaped, narrowing to a forwardmost point) as shown in the Figures herein. Rather, in some embodiments a strikebar may be at least generally linear in shape rather than being slightly V-shaped. In other embodiments, a forward strikebar might be rounded or arcuate in shape. In some embodiments an optional wear roller (not shown in any Figure, but e.g. of the general design of elongate sleeve 70 as shown in FIG. 5) may be provided on the forward strikebar, particularly if the strikebar is linear in shape. The "top" surface of the forward strikebar may or may not comprise a notch or depression to accept forward tip 43 of tongue 42.

A buckle 1 as disclosed herein may be used with any desired strap. In some embodiments, such a strap may be component of a safety apparatus, e.g. a safety harness, belt, sling or the like. Such apparatus might find use e.g. in industrial settings, in climbing or rescue operations, and so on. In some embodiments such a strap may be a component of a functional harness or belt, e.g. a tool belt or the like. In some embodiments such a strap may be configured for use with human clothing, e.g. it may be a belt or a suspender used in conjunction with trousers. In some embodiments such a strap may be used e.g. with life jackets or vests. In some embodiments such a strap may be used to secure items, e.g. to secure items during transportation, to secure a protective tarpaulin onto one or more items, to secure a tent or and so on. Any such use of the herein-disclosed buckle may be envisioned.

LIST OF EXEMPLARY EMBODIMENTS

Embodiment 1A is a buckle comprising: a frame comprising a forward strikebar and comprising a rearward portion that comprises a first laterally-extending slot; a tongue assembly comprising a rearward portion from which forwardly extends at least one elongate tongue, the rearward portion of the tongue assembly comprising a second laterally-extending slot and the tongue assembly exhibiting an axis of rotation about which the tongue assembly is rotatable relative to the frame, wherein the frame and the tongue assembly are configured so that the first and second laterally-extending slots are superimposable with each other so that a terminal section of a strap can be passed through the first and second laterally-extending slots and turned back on itself to form a loop.

Embodiment 1B is a buckle comprising: a frame comprising a forward strikebar and comprising a rearward portion that comprises a first laterally-extending slot; a tongue assembly comprising a rearward portion from which forwardly extends at least one elongate tongue, the rearward portion of the tongue assembly comprising a second laterally-extending slot and the tongue assembly exhibiting an axis of rotation about which the tongue assembly is rotatable relative to the frame, wherein the frame and the tongue assembly are configured so that a terminal section of a strap can be passed through the first and second laterally-extending slots and turned back on itself to form a loop; and, wherein the frame and the tongue assembly are configured so that the axis of rotation of the tongue assembly does not pass through any portion of the frame.

Embodiment 1C is a buckle comprising: a frame comprising a forward strikebar and comprising a rearward portion that comprises a first laterally-extending slot; a tongue assembly comprising a rearward portion from which forwardly extends at least one elongate tongue, the rearward portion of the tongue assembly comprising a second laterally-extending slot and the tongue assembly exhibiting an axis of rotation about which the tongue assembly is rotatable relative to the frame, wherein the frame and the tongue assembly are configured so that the first and second laterally-extending slots are superimposable with each other so that a terminal section of a strap can be passed through the first and second laterally-extending slots and turned back on itself to form a loop; and, wherein the frame and the tongue assembly are configured so that the axis of rotation of the tongue assembly does not pass through any portion of the frame.

Embodiment 2 is the buckle of any of embodiments 1A, 1B and 1C wherein the axis of rotation of the tongue assembly is proximate a rear end of the tongue assembly and is at least generally aligned with a lateral axis of the tongue assembly and with a lateral axis of the frame.

Embodiment 3 is the buckle of any of embodiments 1A, 1B, 1C and 2 wherein the rearward portion of the frame comprises a first laterally-oriented rear crossbar and wherein the rearward portion of the tongue assembly comprises a second laterally-oriented rear crossbar with a long axis that is at least substantially aligned with a long axis of the first laterally-oriented rear crossbar of the frame.

Embodiment 4 is the buckle of embodiment 3 wherein the buckle comprises at least one cincture that co-encircles a laterally-extending portion of the first laterally-oriented rear crossbar of the frame and a portion of the second laterally-oriented rear crossbar of the tongue assembly so as to hold the first and second laterally-oriented rear crossbars in proximity to each other while allowing the tongue assembly to rotate about the axis of rotation.

Embodiment 5 is the buckle of embodiment 4 wherein the at least one cincture is an elongated annular sleeve that extends along, and co-encircles, at least about 60% of an elongate length of the first rear crossbar and at least about 60% of an elongate length of the second rear crossbar.

Embodiment 6 is an assembly comprising the buckle of any of embodiments 3-5 and further comprising a strap comprising a slotless terminal section that is passed through the first and second laterally-extending slots of the buckle and is turned back on itself and fastened to itself to form a terminal loop, which terminal loop co-encircles a laterally-extending portion of the first laterally-oriented rear crossbar of the frame and a laterally-extending portion of the second laterally-oriented rear crossbar of the tongue assembly so as to hold the first and second rear crossbars in proximity to each other while allowing the tongue assembly to rotate about the axis of rotation.

Embodiment 7 is the assembly of embodiment 6 wherein the tongue assembly is not connected to the frame, or held in proximity to the frame, by anything other than the terminal loop of the slotless terminal section of the strap.

Embodiment 8 is the buckle of any of embodiments 3-5 or the assembly of any of embodiments 6-7, wherein the frame further comprises a laterally-oriented intermediate crossbar located between the forward strikebar of the frame and the first, laterally-oriented rear crossbar of the frame, and wherein a rearward edge of the intermediate crossbar of the frame and a forward edge of the rear crossbar of the frame respectively define forward and rearward boundaries of the first, laterally-extending slot of the frame.

Embodiment 9 is the buckle or assembly of embodiment 8 wherein the intermediate crossbar of the frame and the rear crossbar of the frame each extend continuously across an entire lateral extent of the frame between first and second siderails of the frame.

Embodiment 10 is the buckle or assembly of any of embodiments 3-9, wherein the rearward portion of the tongue assembly comprises a laterally-oriented intermediate crossbar from which the forwardly-extending elongate tongue integrally extends, and wherein a rearward edge of the intermediate crossbar of the tongue assembly and a forward edge of the rear crossbar of the tongue assembly respectively define forward and rearward boundaries of the second, laterally-extending slot of the tongue assembly.

Embodiment 11 is the buckle or assembly of embodiment 10 wherein the rear crossbar and the intermediate crossbar of the tongue assembly each extend continuously across an entire lateral width of the rearward portion of the tongue assembly between first and second siderails of the tongue assembly.

Embodiment 12 is the buckle or assembly of embodiment 11 wherein the rear crossbar and intermediate crossbar of the tongue assembly, the first and second siderails of the tongue assembly, and the forwardly-extending elongate tongue of the tongue assembly, are all integral portions of a rigid, single, integral tongue assembly.

Embodiment 13 is the buckle or assembly of embodiment 12 wherein the rigid, single, integral tongue assembly is a single piece of stamped metal.

Embodiment 14 is the buckle or assembly of any of embodiments 3-13, wherein the rear crossbar and the forward strikebar of the frame, and the first and second siderails of the frame, are all are all integral portions of a rigid, single, integral frame.

Embodiment 15 is the buckle or assembly of embodiment 14 wherein the single, integral frame is a single piece of stamped metal.

Embodiment 16 is an assembly comprising the buckle or assembly of any of embodiments 1A, 1B, 1C, and 2-15 and comprising a strap including a slotless terminal section that is passed through the first and second laterally-extending slots of the buckle and turned back on itself and fastened to itself to form a terminal loop, and wherein no portion of the tongue assembly passes through any portion of the slotless terminal section of the strap.

Embodiment 17 is the assembly of embodiment 16 wherein the slotless terminal section of the strap is fastened to itself by stitching.

Embodiment 18 is the assembly of any of embodiments 16-17 wherein the strap is an elongate strap and wherein the slotless terminal section of the elongate strap is a first terminal section that is at a first, buckle end of the elongate strap; and, wherein the elongate strap comprises a second terminal section at a second end of the elongate strap that opposes the first, buckle end, the second terminal section of the elongate strap comprising a series of apertures spaced along an elongate length of the second terminal section, each of which apertures is configured to allow the forwardly-extending elongate tongue of the buckle to pass thereinto in order to buckle the second end of the elongate strap to the first, buckle end of the elongate strap.

Embodiment 19 is the assembly of any of embodiments 16-17 wherein the slotless terminal section of the strap is at a buckle end of a first strap; and, wherein the assembly further comprises a second strap that is a separate strap from the first strap, the second strap being an elongate strap comprising a terminal section comprising a series of apertures spaced along an elongate length of the terminal section of the second strap, each of which apertures is configured to allow the forwardly-extending elongate tongue of the buckle to pass thereinto in order to buckle the second strap to the first strap.

Embodiment 20 is a safety harness comprising a strap with the buckle or assembly of any of embodiments 1-19 attached thereto.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document that is incorporated by reference herein but to which no priority is claimed, this specification as written will control.

What is claimed is:

1. An assembly comprising a buckle comprising:

a frame comprising a forward strikebar and comprising a rearward portion that comprises a first laterally-extending slot;

a tongue assembly comprising a rearward portion from which forwardly extends at least one elongate tongue, the rearward portion of the tongue assembly comprising a second laterally-extending slot and the tongue assembly exhibiting an axis of rotation about which the tongue assembly is rotatable relative to the frame, wherein the frame and the tongue assembly are configured so that the first and second laterally-extending slots are superimposable with each other so that a terminal section of a strap can be passed through the first and second laterally-extending slots and turned back on itself to form a loop;

and, wherein the frame and the tongue assembly are configured so that the axis of rotation of the tongue assembly does not pass through any portion of the frame;

wherein the assembly further comprises a strap including a slotless terminal section that is passed through the first and second laterally-extending slots of the buckle and turned back on itself and fastened to itself to form a terminal loop, and wherein no portion of the tongue assembly passes through any portion of the slotless terminal section of the strap, and wherein the slotless terminal section of the strap is at a buckle end of a first strap; and, wherein the assembly further comprises a second strap that is a separate strap from the first strap, the second strap being an elongate strap comprising a terminal section comprising a series of apertures spaced along an elongate length of the terminal section of the second strap, each of which apertures is configured to allow the forwardly-extending elongate tongue of the buckle to pass thereinto in order to buckle the second strap to the first strap.

2. The assembly of claim 1 wherein the axis of rotation of the tongue assembly is proximate a rear end of the tongue assembly and is at least generally aligned with a lateral axis of the tongue assembly and with a lateral axis of the frame.

3. The assembly of claim 1 wherein the rearward portion of the frame comprises a first laterally-oriented rear crossbar and wherein the rearward portion of the tongue assembly comprises a second laterally-oriented rear crossbar with a long axis that is at least substantially aligned with a long axis of the first laterally-oriented rear crossbar of the frame.

4. The assembly of claim 3 wherein the buckle comprises at least one cincture that co-encircles a laterally-extending portion of the first laterally-oriented rear crossbar of the frame and a portion of the second laterally-oriented rear crossbar of the tongue assembly so as to hold the first and second laterally-oriented rear crossbars in proximity to each other while allowing the tongue assembly to rotate about the axis of rotation.

5. The assembly of claim 4 wherein the at least one cincture is an elongated annular sleeve that extends along, and co-encircles, at least about 60% of an elongate length of the first rear crossbar and at least about 60% of an elongate length of the second rear crossbar.

6. The assembly of claim 3 wherein the terminal loop of the slotless terminal section co-encircles a laterally-extending portion of the first laterally-oriented rear crossbar of the frame and a laterally-extending portion of the second laterally-oriented rear crossbar of the tongue assembly so as to hold the first and second rear crossbars in proximity to each other while allowing the tongue assembly to rotate about the axis of rotation.

7. The assembly of claim 6 wherein the tongue assembly is not connected to the frame, or held in proximity to the frame, by anything other than the terminal loop of the slotless terminal section of the strap.

8. The assembly of claim 3 wherein the frame further comprises a laterally-oriented intermediate crossbar located between the forward strikebar of the frame and the first, laterally-oriented rear crossbar of the frame, and wherein a rearward edge of the intermediate crossbar of the frame and a forward edge of the rear crossbar of the frame respectively define forward and rearward boundaries of the first, laterally-extending slot of the frame.

9. The assembly of claim 8 wherein the intermediate crossbar of the frame and the rear crossbar of the frame each extend continuously across an entire lateral extent of the frame between first and second siderails of the frame.

10. The assembly of claim 3 wherein the rearward portion of the tongue assembly comprises a laterally-oriented intermediate crossbar from which the forwardly-extending elongate tongue integrally extends, and wherein a rearward edge of the intermediate crossbar of the tongue assembly and a forward edge of the rear crossbar of the tongue assembly respectively define forward and rearward boundaries of the second, laterally-extending slot of the tongue assembly.

11. The assembly of claim 10 wherein the rear crossbar and the intermediate crossbar of the tongue assembly each extend continuously across an entire lateral width of the rearward portion of the tongue assembly between first and second siderails of the tongue assembly.

12. The assembly of claim 11 wherein the rear crossbar and intermediate crossbar of the tongue assembly, the first and second siderails of the tongue assembly, and the forwardly-extending elongate tongue of the tongue assembly, are all integral portions of a rigid, single, integral tongue assembly.

13. The assembly of claim 12 wherein the rigid, single, integral tongue assembly is a single piece of stamped metal.

14. The assembly of claim 1 wherein the rear crossbar and the forward strikebar of the frame, and the first and second siderails of the frame, are all are all integral portions of a rigid, single, integral frame.

15. The assembly of claim 14 wherein the single, integral frame is a single piece of stamped metal.

16. The assembly of claim 1 wherein the slotless terminal section of the strap is fastened to itself by stitching.

17. A safety harness comprising the assembly of claim 1.

18. The assembly of claim 1 wherein the forwardly-extending elongate tongue comprises a long axis that is aligned with a forward-rearward axis of the tongue assembly.

19. The assembly of claim 18 wherein the forwardly-extending elongate tongue comprises a forward tip that defines a forwardmost portion of the forwardly-extending elongate tongue.

20. An assembly comprising a buckle comprising:

a frame comprising a forward strikebar and comprising a rearward portion that comprises a first laterally-extending slot;

a tongue assembly comprising a rearward portion from which forwardly extends at least one elongate tongue, the rearward portion of the tongue assembly comprising a second laterally-extending slot and the tongue assembly exhibiting an axis of rotation about which the tongue assembly is rotatable relative to the frame, wherein the frame and the tongue assembly are configured so that the first and second laterally-extending slots are superimposable with each other so that a terminal section of a strap can be passed through the first and second laterally-extending slots and turned back on itself to form a loop;

and, wherein the frame and the tongue assembly are configured so that the axis of rotation of the tongue assembly does not pass through any portion of the frame;

wherein the assembly further comprises a strap including a slotless terminal section that is passed through the first and second laterally-extending slots of the buckle and turned back on itself and fastened to itself to form a terminal loop, and wherein no portion of the tongue assembly passes through any portion of the slotless terminal section of the strap, and wherein the strap is an elongate strap and wherein the slotless terminal section of the elongate strap is a first terminal section that is at a first, buckle end of the elongate strap; and, wherein the elongate strap comprises a second terminal section at a second end of the elongate strap that opposes the first, buckle end, the second terminal section of the elongate strap comprising a series of apertures spaced along an elongate length of the second terminal section, each of which apertures is configured to allow the forwardly-extending elongate tongue of the buckle to pass thereinto in order to buckle the second end of the elongate strap to the first, buckle end of the elongate strap.

* * * * *